United States Patent [19]

Dahlhaus et al.

[11] 4,208,011

[45] Jun. 17, 1980

[54] RAIL CONNECTION ADJUSTABLE LATERALLY AND AS TO HEIGHT

[75] Inventors: Peter Dahlhaus, Radevormwald; Willi Simon, Gevelsberg; Wilhelm Striepeke, Bochum-Langendreer, all of Fed. Rep. of Germany

[73] Assignee: Hoesch Werke Aktiengesellschaft, Dortmund, Fed. Rep. of Germany

[21] Appl. No.: 897,857

[22] Filed: Apr. 19, 1978

[30] Foreign Application Priority Data

Apr. 20, 1977 [DE] Fed. Rep. of Germany ..... 2717394

[51] Int. Cl.[2] ..... E01B 9/66

[52] U.S. Cl. ..... 238/281; 238/282; 238/283; 238/310; 238/332

[58] Field of Search ..... 238/201, 202, 281, 282, 238/283, 310, 331, 332, 349, 172, 264

[56] References Cited

U.S. PATENT DOCUMENTS

| | | | |
|---|---|---|---|
| 302,967 | 8/1884 | Westbrook | 238/202 X |
| 1,364,067 | 1/1921 | Bostrom et al. | 238/332 X |
| 3,640,460 | 2/1972 | Baseler | 238/349 |
| 3,700,167 | 10/1972 | Jennings et al. | 238/281 X |
| 3,831,842 | 8/1974 | Tamura | 238/310 X |

FOREIGN PATENT DOCUMENTS

| | | | |
|---|---|---|---|
| 63452 | 8/1891 | Fed. Rep. of Germany | 238/332 |
| 1158060 | 7/1969 | United Kingdom | 238/349 |

*Primary Examiner*—Randolph A. Reese
*Attorney, Agent, or Firm*—Becker & Becker, Inc.

[57] ABSTRACT

A resilient rail connection is adjustable laterally and as to height, especially for bridge and tunnel sections. An exchangeable intermediate plate and tie screws hold down the foot portion of the rail and are adapted to be screwed into a roadbed. The supporting plate supports the rail and is provided with laterally upwardly extending flanges. An elastic layer cast underneath the supporting plate rests in a recess of the roadbed. Supporting screws which extend through the flanges laterally support holding blocks, which have an oblong hole extending in a direction transverse to the rails. The holding blocks are connected to the roadbed by means of tie screws which extend through the oblong hole and the exchangeable intermediate plate as well as through the supporting plate and the elastic layer.

4 Claims, 4 Drawing Figures

RAIL CONNECTION ADJUSTABLE LATERALLY AND AS TO HEIGHT

The present invention relates to the connection of rails which connection is adjustable laterally as well as to height. More specifically, the present invention concerns a rail connection, especially for bridge and tunnel sections while employing a supporting plate, an exchangeable intermediate plate and tie screws which are adapted to be screwed into a base and hold down the rail foot portion by means of spring elements. Rails have to be adjustable on the roadbed as to height and also laterally. The reason for this requirement consists in that during the first assembly of rails it is not possible to obtain such a precision of the position of the rails as it is necessary for the running of the trains. On the other hand, the necessity frequently arises further to align the tracks after a certain time of operation, especially when the roadbed has settled.

With ordinary railroad tracks with ties located in a gravel bed, the alignment is carried out in such a way that the entire rail/tie frame is laterally displaced and is aligned as to height by pushing gravel below the railroad tie. Recently, a tieless upper structure for instance on concrete plates has been used which does not have this aligning possibility. In German Gebrauchsmuster 17 74 161 there is described how an alignment of the later location of the track can be effected. The lateral correction is obtained through the intervention of corresponding tooth surfaces of a washer plate by means of a pressure plate. The correction as to height according to German Offenlegungsschrift 20 32 915 is effected by shimming by means of intermediate plates having different thicknesses.

A design of an alignable rail connection of this type has the drawback that the lateral alignment can be effected only in steps in conformity with the tooth deviation or pitch circle of the tooth surfaces. Furthermore, it is a disadvantage that the correction as to height and the lateral correction can be combined in one rail connection. The described connections furthermore result in a relatively high construction and in view of the great number of individual elements are rather expensive.

It is, therefore, an object of the present invention to provide a resilient connection which is laterally adjustable and adjustable as to height and which permits an infinitely variable lateral adjustment which results in a low overall structure and will be economical.

It is a further object of this invention to provide a resilient connection as set forth above, in which the lateral correction and the correction as to height can be carried out at any desired time.

These and other objects and advantages of the invention will appear more clearly from the following specifications in connection with the accompanying drawings, in which:

FIG. 1 diagrammatically illustrates a connection in the direction of the rail, shown up to about the longitudinal rail axis.

Figure 1:
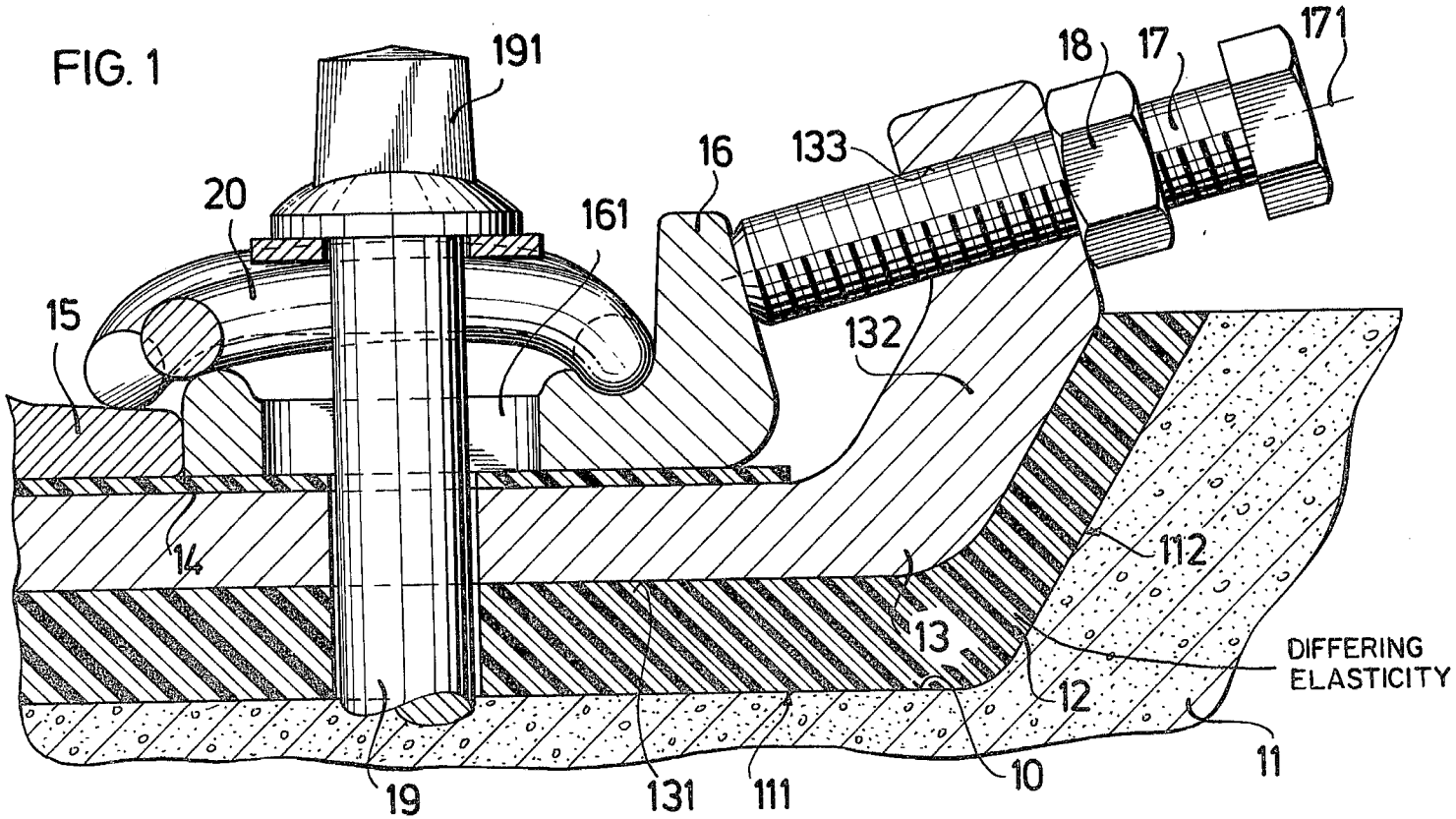
Figure 2:
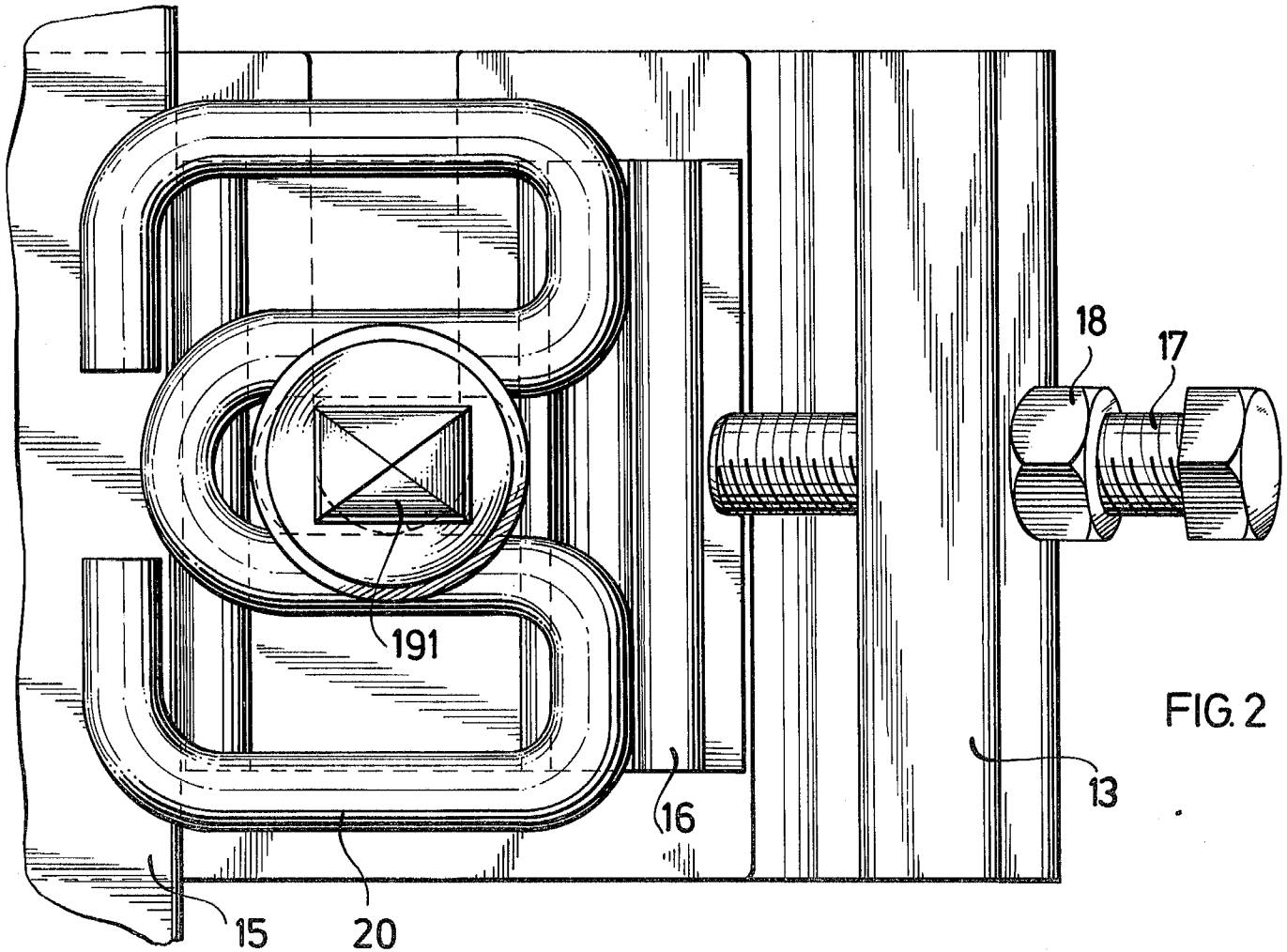
FIG. 2 shows a plan view of the connection of FIG. 1.

The resilient rail connection according to the present invention is characterized primarily in that the supporting plate which supports the rail by means of laterally upwardly extending flanges and by means of an elastic layer cast therebelow rests in a recess of the roadbed. The rail connection according to the invention is furthermore charcterized in that supporting screws extending through said flanges and provided with an oblong hole in the transverse direction of the rails laterally rests against holding blocks adjoining the foot portion of the rails. These holding blocks are connected to the roadbed by means of tie screws extending through the oblong hole, the exchangeable intermediate plate, the supporting plate, and the elastic layer.

In order to prevent a tilting of the holding block at any level of the rail, it is, according to a further development of the invention, provided that the extension of the central line of the supporting screw always hits the pertaining vertical outer surface of the foot portion of the rail, preferably in the lower region at the lower edge of the rail foot portion.

In order to obtain a good lateral support of the rail connection when mounting the rails in concrete, and furthermore to assure an elastic mounting in vertical direction, it is, according to a still further development of the invention, provided that the elastic layer, within the region of the bottom surface, is softer than the elastic layer within the region of the lateral surfaces and/or within the region of the bottom surface is thicker than within the region of the lateral surfaces.

The exchangeable intermediate plate—the exchangeability relates to the employment of intermediate plates of different thicknesses—extends below the rail as well as the holding blocks. As a result thereof, a simple lateral alignment will be realized.

Referring now to the drawings in detail, in a recess 10 of a roadbed 11 which may represent for instance the concrete floor of a tunnel, of a bridge, or the profile of a tieless upper structure, there is arranged a supporting plate 13 while an elastic layer 12 is cast between said supporting plate 13 and the roadbed 11. The supporting plate 13 has a plane surface 131 which at the ends ends in upwardly directed preferably thickened flanges 132. A foot portion 15 of a rail not further illustrated rests on an exchangeable intermediate plate 14 which preferably consists of synthetic material. In the particular embodiment shown, the intermediate plate 14 may vary as to thickness between 3 mm and 11 mm so that thereby the height difference of 8 mm between the rail and the roadbed 11 can be compensated for.

The lateral location of the rail is confined by holding blocks 16. These holding blocks 16 rest radially against the supporting screw 17 which is screwed through the upwardly extending flange 132. By means of turning said supporting screws 17 by screwing in said supporting screws 17, the holding blocks 16 are displaced. In this connection, a lateral alignment of the rail of for instance 10 mm toward each side is possible. The position of the supporting screws 17 may, for instance, be secured by counter nuts 18. The lateral fine alignment of the rail is effected with the holding blocks 16 pushed back. The holding blocks 16 are then by means of supporting screws 17 displaced up to the foot portion 15 of the rails. As a result thereof, the aligned position of the rails is secured.

In order to prevent a tilting of the holding blocks 16, a threaded bore 133 is provided for the supporting screws 17. The threaded bore 133 is arranged with such an inclination in the flange 132 that the extended center line 171 of the supporting screws 17 while considering the thinnest intermediate plate 14 and while displacing the rail to the widest point to the pertaining upwardly extending flange 132 rests against the pertaining vertical outside surface of the rail foot portion 15 as counter-bearing.

The rail connection can be connected to the roadbed 11 for instance in such a way that a tie screw 19 screwed into a dowel (not illustrated) of the roadbed 11 extends through the cast below elastic layer 12, the supporting plate 13, the intermediate plate 14, and the oblong hole 161 of the holding block 16, while the head 191 of the tie screw 19 acts upon spring elements 20 known per se holding down the rail foot portion 15.

The rough adjustment of the rail connection is such that after the measuring has been carried out, the supporting plates 13 are inserted into the roadbed 11 and by means of shims, wedges or the like are aligned. After this way of locating has been assured, the connection of roadbed 11 and supporting plate 13 is by casting below preferably a synthetic material, within the region of the bottom surface 111 of the roadbed 11 provided thicker than in the region of the lateral surfaces 112 of the roadbed 11. Furthermore, it may be provided in accordance with the present invention that the synthetic material undercast within the region of the bottom surface 111 is effected in a softer quality than within the region of the lateral surfaces 112. After the undercast of synthetic material has been hardened, a fixed connection between roadbed 11 and supporting plate 13 may be assured.

Figure 3:
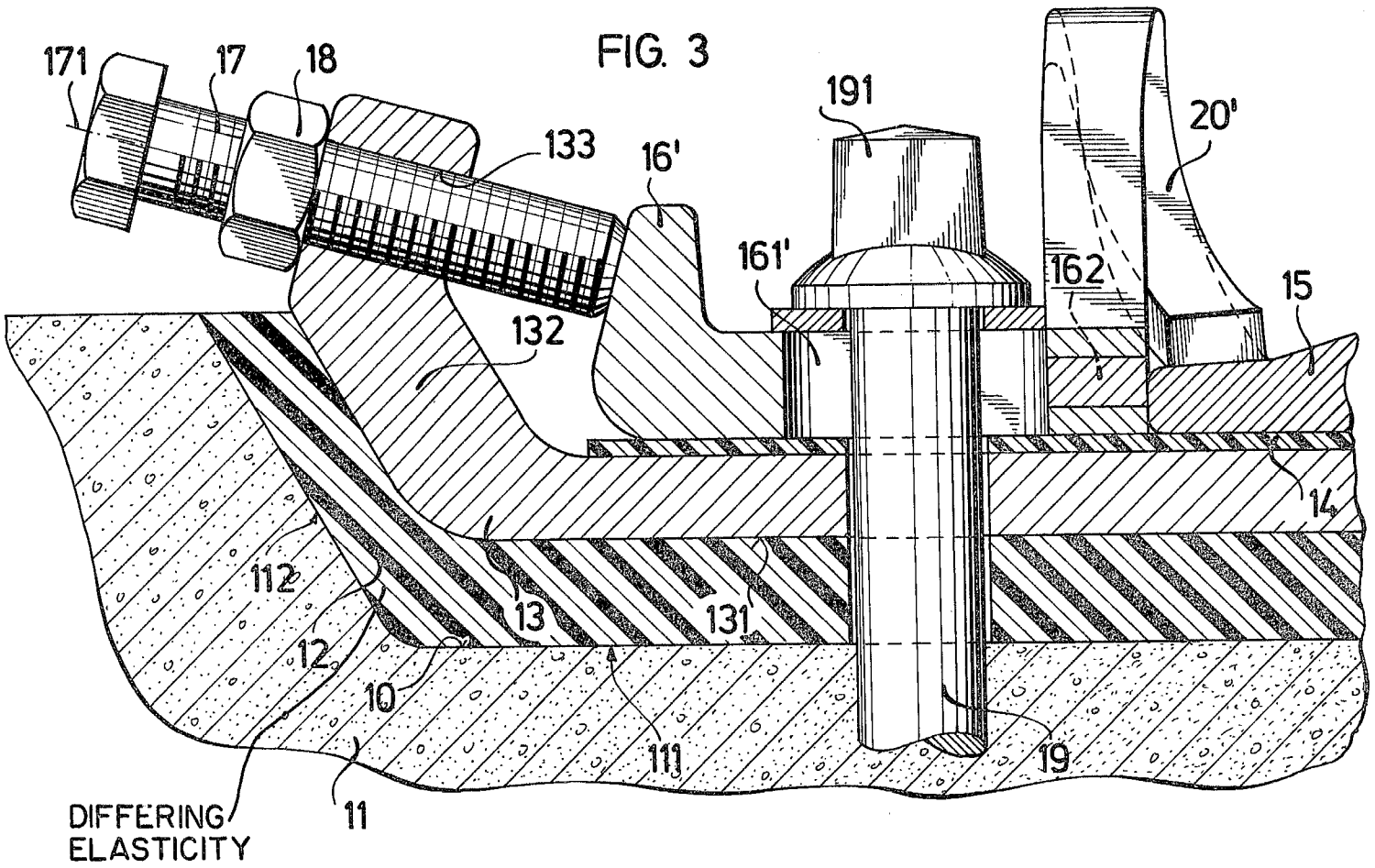
FIG. 3 represents a connection with another spring element.
Figure 4:
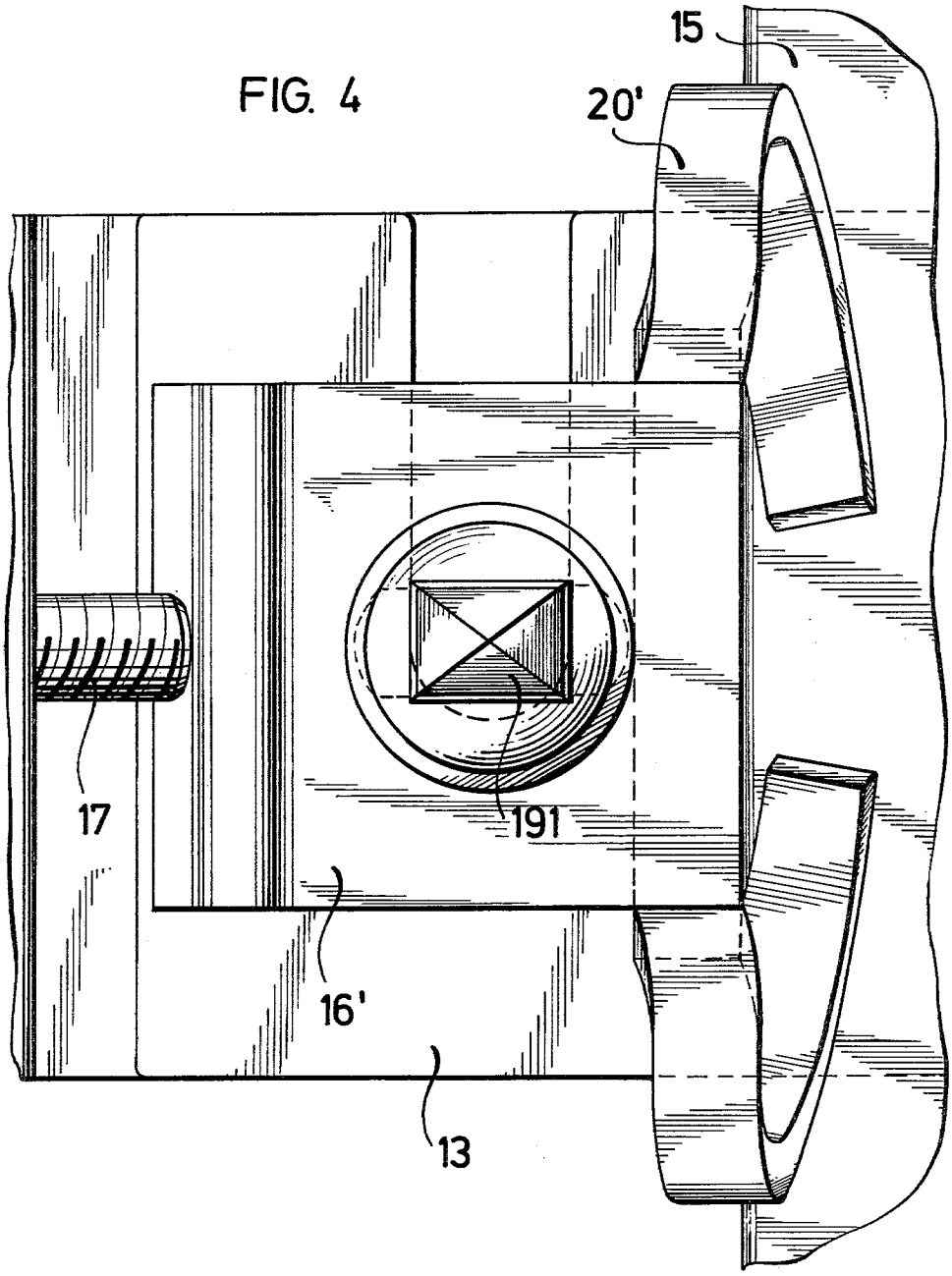
FIG. 4 shows a top view of the connection of FIG. 3.

The FIGS. 3 and 4 show a similar rail connection of the invention with primes being added to designate corresponding components. In this connection, a different spring element 20' is inserted which is held in a groove 162 of the holding block 16'. The head 191 of the tie screw 19 acts upon the holding block 16' while the down-holding force is through the holding block 16' and the spring element 20' conveyed to the rail foot portion 15.

The advantages of the invention consist primarily in that the described connection needs only relatively few and simple elements so that on one hand the keeping of stock is reduced and on the other hand the connection is relatively inexpensive. Furthermore, the connection according to the invention permits an infinitely variable lateral alignment of the rail while the lateral alignment, as is generally customary, can be effected from a rail aligning carriage in a simple manner. Furthermore, the described connection has a low overall height which is particularly advantageous when employed in tunnels the overall height of which, among others, also depends on the height of the rail connection and materially affects the cost of construction. The described connection requires only two normal tie screws which, for instance, can be connected through dowels with the concrete roadbed.

A further advantage of the arrangement according to the invention consists in that the spring element cooperates with the elastic layer 12 by preloading the tie screws so that only slight vibrations can be conveyed from the rail and connecting system into the roadbed. By designing the elastic layer with different hardness and/or different thickness, the advantage will be realized that on one hand the lateral rail forces can without material deviation of the rails be absorbed by the concrete roadbed, and on the other hand, a good vibration absorption will be obtained in vertical direction. Accordingly, the elastic layer is softer in the region of its bottom area than within its region of its lateral surface on the one hand and alternately the elastic layer is thicker in the region of its bottom surface than in the region of its lateral surface.

It is, of course, to be understood that the present invention is, by no means, limited to the specific showing of the drawing, but also comprises any modifications within the scope of the appended claims.

What we claim is:

1. In combination with a roadbed having a recess transverse thereto, a resilient rail connection adjustable both laterally and also as to height, which includes: a supporting plate for supporting the rails of a railway track, said supporting plate being aligned with and at least partly resting in said recess, an elastic layer cast between said roadbed and said supporting plate, said supporting plate being provided with laterally upwardly extending flanges, said supporting plate and said elastic layer being provided with a substantially vertical bore, holding block means arranged above and supported by said supporting plate and provided with an oblong hole axially aligned with said bore and extending transverse to the railway track of which the rails have to be connected to the roadbed, said holding block means being adapted to engage the foot portion of a rail of a railway track, spring means partially resting on said holding block means for engagement with the foot portion of said last mentioned rail, said spring means being provided with a passage axially aligned with said bore, tie screw means anchored in said roadbed and extending through said passage and said oblong hole and said bore of said supporting plate as well as through said bore of said elastic layer for clamping down said spring means onto said block means and clamping the latter and said supporting plate against said elastic layer, said flanges of said supporting plate being provided with transverse bores, adjustable screw means extending through said transverse bores and engaging said holding block means for also effecting a lateral adjustment thereof, and height adjustment means which includes an intermediate plate interposed between said supporting plate and said rail and holding block means, whereby said spring means engages said rail with a substantially uniform preloading force.

2. An arrangement in combination according to claim 1, in which the extension of the center line of said adjustable screw means intersects the substantially vertical outer surface of the front portion of a rail to be adjusted by said adjustable screw means.

3. An arrangement in combination according to claim 1, in which said elastic layer is softer in the region of its bottom area than within the region of its lateral surface.

4. An arrangement in combination according to claim 1, in which said elastic layer is thicker in the region of its bottom surface than in the region of its lateral surface.

* * * * *